US005495695A

United States Patent [19]

Elliott, Jr.

[11] Patent Number: 5,495,695

[45] Date of Patent: Mar. 5, 1996

[54] VAULTED UNDERGROUND STORAGE TANK

[75] Inventor: Thomas P. Elliott, Jr., Houston, Tex.

[73] Assignee: Dalworth Concrete Products, Inc., Katy, Tex.

[21] Appl. No.: 381,272

[22] Filed: Jan. 31, 1995

Related U.S. Application Data

[63] Continuation of Ser. No. 7,311, Jan. 21, 1993, abandoned.

[51] Int. Cl.[6] ..... E04C 3/10; E02D 29/14

[52] U.S. Cl. ..... 52/20; 52/21; 52/135; 52/79.1; 52/192; 52/169.6; 52/169.7; 405/52; 405/53; 220/565

[58] Field of Search ..... 52/19–21, 169.1, 52/169.6, 169.7, 169.8, 192, 128, 133, 135, 79.1, 745.01; 405/52, 53, 55; 220/505

[56] References Cited

U.S. PATENT DOCUMENTS

| | | |
|---|---|---|
| 26,481 | 12/1859 | Doyere . |
| 761,548 | 5/1904 | Sheaff . |
| 1,188,446 | 6/1916 | Haines . |
| 1,520,230 | 12/1924 | Flath . |
| 1,958,487 | 5/1934 | Moran . |
| 2,095,256 | 10/1937 | Horton . |
| 2,136,390 | 11/1938 | McHugh . |
| 2,166,913 | 7/1939 | Little . |
| 2,331,483 | 10/1943 | Lawman et al. . |
| 2,333,315 | 11/1943 | Klingberg . |
| 2,341,547 | 2/1944 | Heineman . |
| 2,398,828 | 4/1946 | Gray . |
| 2,408,105 | 9/1946 | Starret . |
| 2,507,597 | 5/1950 | Holdridge . |
| 2,531,742 | 11/1950 | Pomykala . |
| 2,544,828 | 3/1951 | Dobell . |
| 2,629,348 | 2/1953 | Kifferstein . |
| 2,931,211 | 4/1960 | McCullough . |
| 2,984,898 | 5/1961 | Svensson . |
| 3,314,567 | 4/1967 | Becker et al. . |
| 3,429,473 | 2/1969 | Vroman et al. . |
| 3,448,885 | 6/1969 | Parks . |
| 3,464,175 | 9/1969 | Akita et al. . |
| 3,471,599 | 10/1969 | Archer . |
| 3,481,504 | 12/1969 | Nelson . |
| 3,545,213 | 12/1970 | Sebor et al. . |
| 3,562,977 | 2/1971 | Alleaume . |

(List continued on next page.)

FOREIGN PATENT DOCUMENTS 1301744 4/1987 U.S.S.R. ..... 220/565

OTHER PUBLICATIONS

S.C.V. Corp., The Surevault, Aug. 10, 1990.

Robert P. Ouellette, The Underground Storage Tank Market, Jan./Feb. 1992.

"ECOVAULT—Engineered for the Environment," UNISIL, Inc. Product Brochure, 4 pages, Date Not Listed.

General Specifications, Sannipoli Corp., 1 page, Date Not Listed.

(List continued on next page.)

*Primary Examiner*—Carl D. Friedman

*Assistant Examiner*—Robert J. Canfield

*Attorney, Agent, or Firm*—Knobbe, Martens, Olson & Bear

[57] ABSTRACT

An underground storage system for hazardous liquids having an inner fluid storage tank surrounded by a larger outer containment vault with sufficient space between to allow for visual inspection of the tank. The inner tank has a rectangular parallelepiped shape and is positioned within an outer rectangular parallelepiped vault in a manner leaving a larger clearance space between two adjacent tank sides and facing vault walls than between the opposite adjacent two sides and walls. Additionally, a vertical clearance exists between the tank and vault. The vault is reinforced concrete precast in sections for ease of transport and assembly on-site. The vault has a bottom pan-shaped unit with one or more square tubular collar units on top and terminates in an upper cover. The cover includes one or more man-way apertures enabling a technician to enter the vault and inspect the tank for leaks. The increased use of excavated space for fluid storage reduces costs associated with transport and installation.

53 Claims, 5 Drawing Sheets

U.S. PATENT DOCUMENTS

| | | | |
|---|---|---|---|
| 3,640,038 | 2/1972 | Heron . | |
| 3,672,103 | 6/1972 | Kost | 52/169.6 X |
| 3,848,765 | 11/1974 | Durkop . | |
| 3,995,472 | 12/1976 | Murray . | |
| 4,110,947 | 9/1978 | Murray et al. . | |
| 4,153,103 | 5/1979 | Bachli . | |
| 4,183,221 | 1/1980 | Yamamoto . | |
| 4,233,789 | 11/1980 | Dinardo . | |
| 4,242,847 | 1/1981 | Rezin . | |
| 4,366,654 | 1/1983 | Bomhard . | |
| 4,425,743 | 1/1984 | Bartur . | |
| 4,607,522 | 8/1986 | Sharp . | |
| 4,638,920 | 1/1987 | Goodhues, Jr. . | |
| 4,653,312 | 3/1987 | Sharp . | |
| 4,717,285 | 1/1988 | Pulkkinen . | |
| 4,776,138 | 10/1988 | Sumner et al. . | |
| 4,787,772 | 11/1988 | Wagner . | |
| 4,826,644 | 5/1989 | Lindquist et al. . | |
| 4,869,033 | 9/1989 | Duvieusart et al. . | |
| 4,931,235 | 6/1990 | Linquist et al. . | |
| 4,934,122 | 6/1990 | Lindquist . | |
| 4,950,105 | 8/1990 | Meess et al. . | |
| 4,960,151 | 10/1990 | Kaminski et al. . | |
| 4,961,293 | 10/1990 | House et al. . | |
| 4,963,082 | 10/1990 | Lindquist et al. . | |
| 4,978,249 | 12/1990 | Killman | 405/53 X |
| 4,986,436 | 1/1991 | Bambacigno et al. . | |
| 5,037,239 | 8/1991 | Olsen et al. . | |
| 5,045,327 | 9/1991 | Tarlow et al. . | |
| 5,090,713 | 2/1992 | Johnson | 52/169.7 X |
| 5,157,888 | 10/1992 | Lindquist | 52/745.01 |

OTHER PUBLICATIONS

"Petro Vault—There is no Equal," Product Brochure, 2 pages, Date Not Listed.

"Above Ground Storage!," We dland Mfg. Co., 1 page, Date Not Listed.

"Enviro–Vault," B.R.E. Products, Inc. Product Brochure, Installation Instructions, Specifications and Related Papers, Multiple pages, Aug. 27, 1990.

"Best Above Ground Fuel Storage Tank," Trusco Tank, Inc., Supervault Product Brochure, Price List and Specifications, Multiple Pages, Date Not Listed.

"Hi–Tech Vaults," Hausner's Inc. Product Advertisement and Features, 3 pages, Date Not Listed.

"Surevault," S.C.V. Corp. Product Brochure and Specifications, 5 pages, Date Not Listed.

"Lube Cube Vault Tank," Hoover Group, Inc. Advertisement and Specifications, 2 pages, Date Not Listed.

VAULTED UNDERGROUND STORAGE TANK

This application is a continuation of application Ser. No. 08/007,311, filed Jan. 21, 1993 abandoned.

BACKGROUND OF THE INVENTION

The present invention relates to an underground facility for the storage of liquids and, more particularly, to a fuel storage tank within a segmentalized precast concrete vault, the assembly having a highly efficient fuel storage capacity to overall displacement volume ratio.

Underground storage tanks are frequently used for the storage of various liquids, such as gasoline, fuel oil, diesel oil, toxic fluids or various chemicals. These underground storage tanks are used in retail automobile service stations, truck and bus depots, for various industrial and commercial facilities, and occasionally, for homes and consumer purposes. The storage tanks are generally tubular, consist of a welded construction of sheet steel of sufficient gauge, and have a capacity ranging from 500–50,000 gallons.

For some time the Environmental Protection Agency (EPA) has recognized that the United States faces a costly underground storage and pollution problem. The old methods of storing liquids, chemicals and hazardous materials are not acceptable. Gasoline stations, for example, previously used single-wall direct bury tanks for their on-site gasoline storage. After a relatively short time, these underground storage tanks leak—contaminating the ground water in the surrounding land and endangering the public. Detecting these leaks is difficult and usually only occurs after gasoline has been leaking for a considerable time. Replacing or repairing these underground tanks is very expensive and time-consuming. More recently, some tanks have been made of fiberglass, but such tanks are subject to cracking or other problems which cause these tanks to leak also.

As existing underground tanks are, on average, 25 years old, and as the risk of leaks increases substantially after 12 years, it is currently estimated that up to about 20% of underground storage tanks are probably leaking. In view of concerns regarding environmental problems associated with leaking underground storage tanks, some years ago the EPA adopted regulations requiring regular leakage testing of underground storage tanks and the carrying of insurance policies or providing evidence of financial responsibility to cover the cost of any required environmental clean-up. Complying with these regulations has significantly added to the cost and responsibility of owning and operating underground storage tanks. In many cases, the required insurance, if available at all, is so expensive that independent gas station owners cannot afford it.

The EPA's regulations do not apply, however, when the storage tanks themselves are not directly buried but are placed within a structure or vault where they can be inspected and where any leakage can be contained. Hence, placing storage tanks within a structure, either above ground or underground, is a way to both gain exclusion from EPA regulations and prevent environmental problems. In addition, contamination concerns of financiers and future land owners, as well as the potentially crippling expense of contamination clean-up, are alleviated with the use of a storage tank within an enclosing structure.

To qualify for the EPA underground storage tank regulation exclusion, the tank must be situated upon or above the surface of the floor of an underground area such that inspection for leaks is possible. However, an inspector must first gain access to an underground vault to visually inspect the exterior of an enclosed tank. In order to comply with OSHA (Occupational Safety and Health Administration) access regulations, there is a minimum access ladder area width requirement of 30 inches and at least an 18 inches wide confined access space between the sides of the tank and vault is required.

U.S. Pat. Nos. 4,638,920 issued to Goodhues, Jr., 4,961,293 to House, et al. and 5,037,239 to Olsen, et al. disclose underground concrete vault structures designed to enclose hazardous liquid storage tanks. These patents show tubular tanks within generally rectangular parallelepiped vaults where a certain amount of space or clearance is left around the vaults to provide for access and visual inspection.

In urban areas, it is common for service stations and convenience store facilities to be located on an expensive, busy intersection site where rights of way and utility easements are enlarged as the area develops. Frequently, these public acquisitions result in tank encroachments that must be resolved. Typically, an aging storage tank which is positioned partially in a public easement space must be replaced due to leaking. Once the owner has removed the existing tank and/or vault, the city or municipality often refuses to allow the space within the public easement to be used when situating a new tank.

Unfortunately, this problem cannot always be overcome by digging a deeper hole in the ground to install a taller tubular vault. Depending on the local geology, the water table may be from 2 feet deep in coastal areas to around 15 feet deep inland. Safety regulations become stiffer when digging below the water table due to the extra shoring needed and larger excavation machines to reach deeper below ground. Thus, digging deeper becomes more expensive and is often not a viable alternative.

Prior underground vaulted tanks have exclusively utilized horizontal tubular internal tanks, common in the retail gasoline industry. Tubular tanks are considerably cheaper to manufacture than other configurations. It is well-known that a round internal tank is more economical than other shaped tanks to contain liquids because of the reduced stresses inherent in the design. However, the concrete vaults surrounding the internal tank are typically constructed with rectangular cross sections due to the ease of digging similarly-shaped holes in the ground and forming concrete in flat walls rather than round walls, as well as the need to provide a flat surface as a platform for inspection access.

Other drawbacks are also associated with the installation of existing underground vaulted tanks. Assuming the assembly of an outer square cross-section concrete vault pre-cast in pieces, the difficulties associated with transportation of such large pieces becomes significant. There are restrictions on trucking capacity, not only for traffic safety, but also because the roads have a maximum load bearing strength. Furthermore, the cranes used to lift the pieces onto waiting trucks and then to unload the concrete sections have a maximum tonnage lift capacity. There is typically a maximum crane size which is practical for on-site installation, thus limiting the possible site access.

One example of an existing vaulted tank is a 10,000 gallon storage capacity unit manufactured and sold by Secondary Containment Vaults (SCV) of San Antonio, Tex. under the trademark SUREVAULT. The vault portion consists of six prestressed, precast units: a bottom unit, a collar unit and a cover comprised of four flat panels. The storage tank is a cylinder having a length of approximately 28 feet and a diameter of 8 feet. The outer dimensions of the rectangular vault are 31'-8" by 12'-0" by 11'-8.5". The largest component is the bottom unit which forms a cradle for the tank and weighs 79,300 lbs. Disadvantageously, most states require special trucking permits for loads greater than 50,000 lbs and, in order to transport such a large piece, an escort vehicle may be necessary. Furthermore, a crane having an 140 ton capacity would be needed to lift the largest piece safely at a 25' reach, and such a crane typically rents for a steep hourly rate as compared to a smaller sized crane having a 65 ton capacity. For instance, in one region, crane rental rates for a 140 ton crane are 175% of the cost of a 65 ton crane.

Rectangular parallelepiped tanks encased in concrete are presently used for above-ground tank installation. The primary purpose of the concrete encasement of an above-ground tank is to provide fire protection. However, the concrete encasement also provides secondary fuel containment. Typically, the clearance between the concrete and the inner tank varies from approximately ¼ inch to 2 inches to serve as a space for allowing free transport of any primary tank leakage to a lower point where the leakage can be readily sensed by various means of leak detection. These designs neither permit, nor do they meet EPA standards for visual inspection of, or OSHA standards for physical access, to the tank.

Despite the fact that rectangular tanks cost approximately twice as much to build as a tubular tank, rectangular internal tanks are used in rectangular above-ground vaults because the exterior concrete that encases the interior tank can more easily be monolithically cast, thereby eliminating the need for joints in the concrete which present sealing, and therefore potential fire, problems. Examples of such above-ground storage tanks are shown in U.S. Pat. Nos. 4,931,235 and 4,934,122. This type of fire risk is not significant in the underground tank environment.

There is currently a need for an improved underground storage tank within an access vault which addresses the limitations of the prior art.

SUMMARY OF THE INVENTION

The present invention provides an improved underground vaulted storage tank for hazardous liquids. A rectangular parallelepiped shaped internal hazardous liquid storage tank is installed within an external rectangular parallelepiped concrete vault with a sufficient amount of space left on two of the four sides for visual inspection of the internal tank and a sufficient amount of space left on the other two sides for physical access to the internal tank. The internal tank may be constructed of steel or other materials and, desirably, has openings as required for piping connections to fill, vent, or pump from the tank. The external vault provides a structure which serves as a means to hold back the soil, keep the internal tank free from contact with water and corrosive elements, and provide an accessible space to readily inspect and/or repair the internal tank.

Advantageously, land area used to install the vault for the underground storage tank is minimized because of the overall size of the vault compared with a vault used to store a comparably sized tank of the prior art. In addition, the excavation size is reduced, therefore reducing digging costs. Another benefit is the reduction in the volume of materials required to construct the vault due to the reduced overall size. Finally, transportation costs are reduced due to the size reduction of the underground storage vault components.

In a preferred embodiment, the external vault is precast in four main sections. A bottom section comprises a flat bottom with four upstanding walls around the periphery. The bottom is approximately one- to two-thirds the total height of the vault and may have a square horizontal cross section or a cross section longer in one dimension than the other, preferably in a ratio of approximately 1.25:1. Preferably, the bottom is between 3 and 6 feet in height and, more preferably, has a height of 4'-9". The horizontal cross section is between 10–22 feet long (advantageously 10–17 feet long) and between 8–14 feet wide and, desirably is 16'-4"× 13'-4" in cross section.

One or more rectangular tubular sections of the same peripheral dimensions as the bottom mount on top of the bottom section with a mating groove around the edges. A top cover of between 6 and 12 inches in thickness fits over the top edge of the upper square tubular member to complete the sealed box-shaped structure. The rectangular tubular sections are between approximately 2 and 6 feet in height resulting a total vault height of between 8 and 16 feet.

The present invention contemplates construction of various sizes of underground storage vaults enclosing tanks having storage capacities of 4,000 gallons to 10,000 gallons and above. The horizontal cross sections of the storage tanks are preferably constant for all capacities, the tanks thus having varying heights. Preferably, the internal tank horizontal cross-section dimensions are approximately 108"× 156", and the height varies from approximately 56" to 138". The storage tanks are preferably fabricated of between 3/16" and ¼" ASTM A-36 steel plate. The system may be provided with just one primary tank or with a primary tank and an outer tank for secondary liquid containment. Both primary and secondary tanks are preferably Underwriters Laboratories 142 Listed tanks for storage of flammable liquids.

The present invention advantageously makes use of some part interchangeability between the different capacity storage vaults. For instance, the same bottom portions and covers may advantageously be used for all of the different sizes of tanks with varying heights and numbers of square tubular members placed between the bottom member and cover. Desirably, the bottom section has a total height of 4'-9" and the cover is 9 inches thick.

In accordance with a preferred construction, the external vault for a 4,000-gallon storage tank system may have a bottom section and one 3-foot tall square tubular section topped with a cover for a total height of 8'-6". A 6,000-gallon capacity storage tank system may have an external vault with a similar bottom section and a 5 foot tall square tubular member with a cover on top for a total height of 10'-6". An 8,000-gallon storage tank system includes an identical bottom section, with a lower 5 foot tall square tubular section and an upper 3-foot square tubular section onto which the cover is placed for a total height of 13'-6". A 10,000-gallon capacity storage tank system may have an external vault with a 4'-9" tall bottom section, two 5 foot tall square tubular sections and a cover on top for a total height of 15'-6". All of these different sized underground storage tanks thus advantageously utilize some of the same components, saving costs, while the horizontal cross section of the vault remains constant and the height of the vault changes.

Each of the various sized storage tanks desirably includes an upper tubular tank man-way extending from the top surface of the tank to the cover of the external vault. A gasketed vault man-way in the cover allows access to the cylindrical tank man-way for an inspector to view the interior of the storage tank. Additionally, a second vault man-way, desirably having a diameter of 30 inches, is provided in the cover of the external vault. This second vault man-way provides access to the clearance space within the external vault and around the internal tank. Preferably, the gasketed vault man-way is disposed proximate a corner of the vault. Steel steps are desirably provided on the interior of the vault adjacent the second man-way to allow an inspector to descend to the bottom of the vault.

In a preferred embodiment, a first physical access gap is provided between the internal storage tank and the external vault along one side wall, and is desirably between 12" and 30" wide. Preferably the first physical access gap is between 18" and 24" and, more preferably, the gap is 18" wide. In addition, a second physical access gap is provided along a second side wall between the vault and tank and is desirably between 20" and 40" wide, and preferably is 30" wide. Additionally, a first visual inspection gap along a third side wall between the vault and tank is provided. The first visual inspection gap is desirably between 2" and 10" wide, and preferably the gap is 6" wide. Desirably, the tank is situated such that a second visual inspection gap is provided along a fourth side wall between the vault and tank and is between 2" and 10" wide, and preferably 6" wide. Desirably, the 18-inch first physical access gap is adjacent one of the short sides of the tank and the 30-inch second physical access gap is adjacent one of the long sides of the rectangular storage tank.

In accordance with the preferred storage vault and tank, a secondary tank is provided and the vault provides a tertiary containment structure. The primary and secondary storage tanks comprise spaced apart steel sheets while the tertiary vault containment is provided by a narrow strip of a material such as Hypalon, manufactured by Dupont, epoxied across the internal cracks between vault sections. Additionally, a watertight joint sealant between the sections is provided to prevent ground water intrusion. Other arrangements with only a primary storage tank provided and either no secondary fuel containment seal or a cast-in polymer liner for secondary containment are contemplated.

Pre-cast, steel or assembled risers of approximately 2 inches in height are desirably placed at spaced intervals underneath the internal storage tank to lift the storage tank above the floor of the vault and allow for sensing of any leaking substances underneath the tank. Furthermore, the tank is desirably anchored to the floor of the vault to satisfy earthquake code requirements and resist internal tank float-up.

DESCRIPTION OF THE PREFERRED EMBODIMENTS

Figure 1:
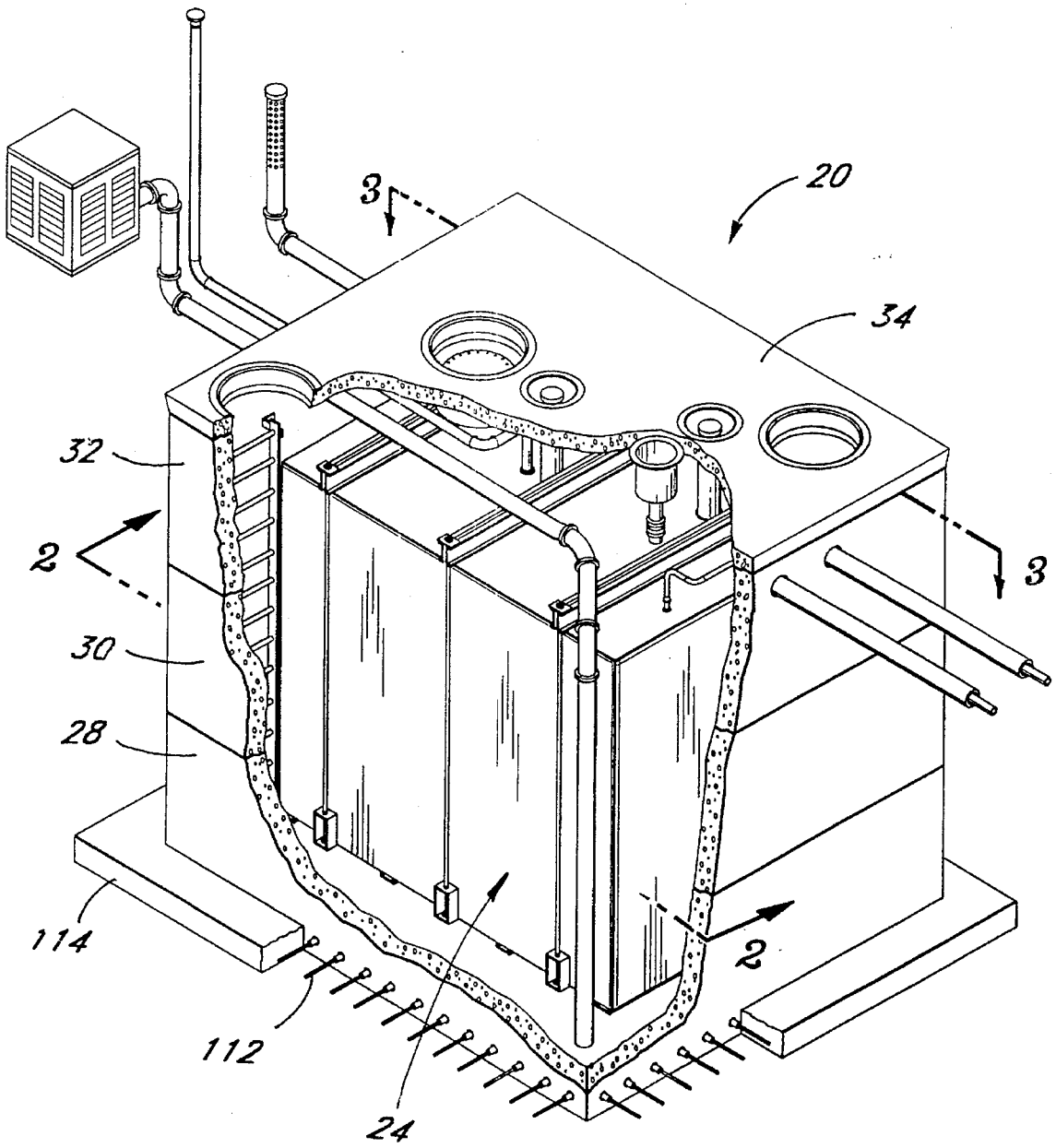
FIG. 1 is a partially cutaway perspective view of the underground storage tank and vault system of the present invention having a vault in four sections.
Figure 2:
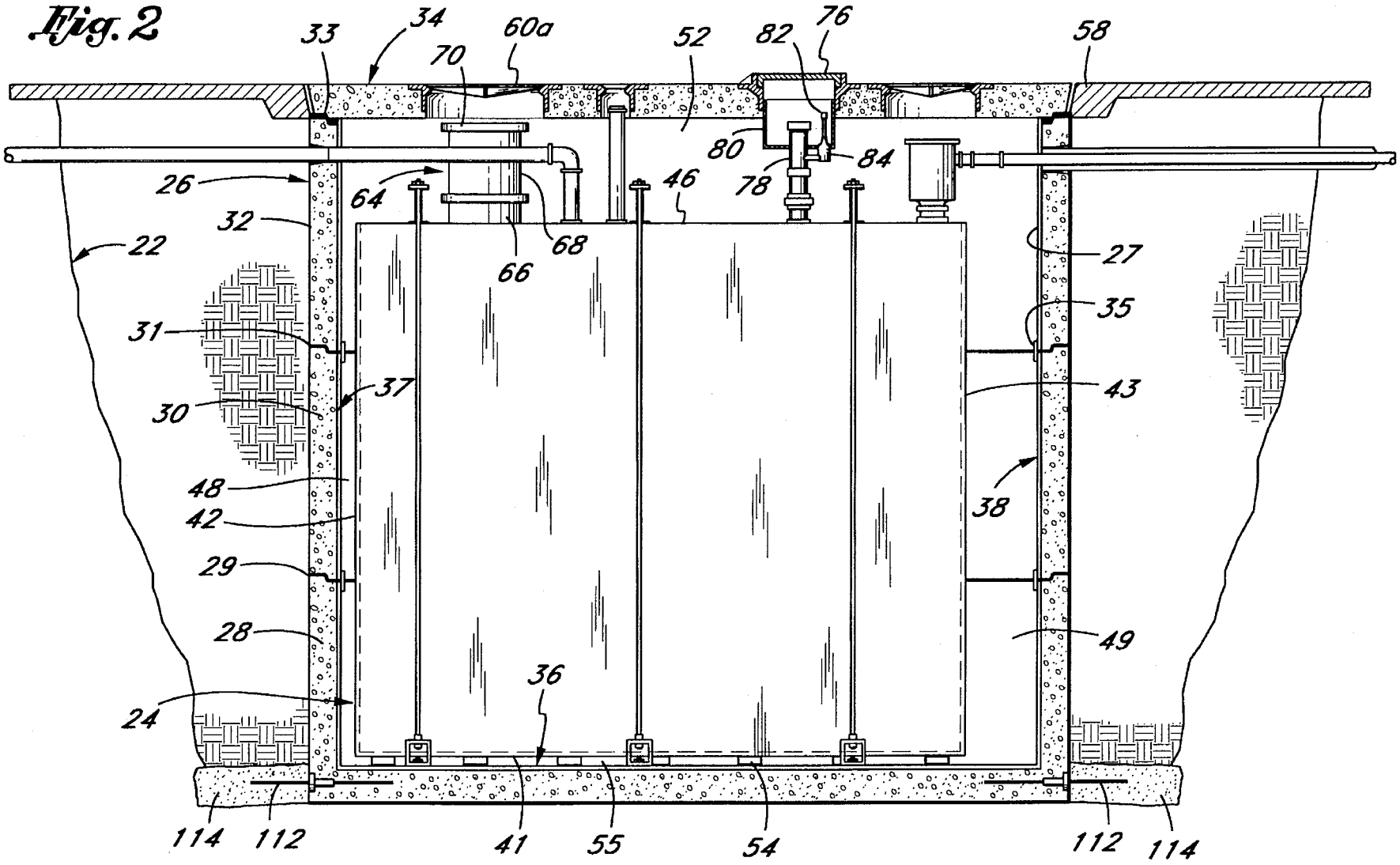
FIG. 2 is a sectional view of the system of FIG. 1 along line 2—2.
Figure 3:
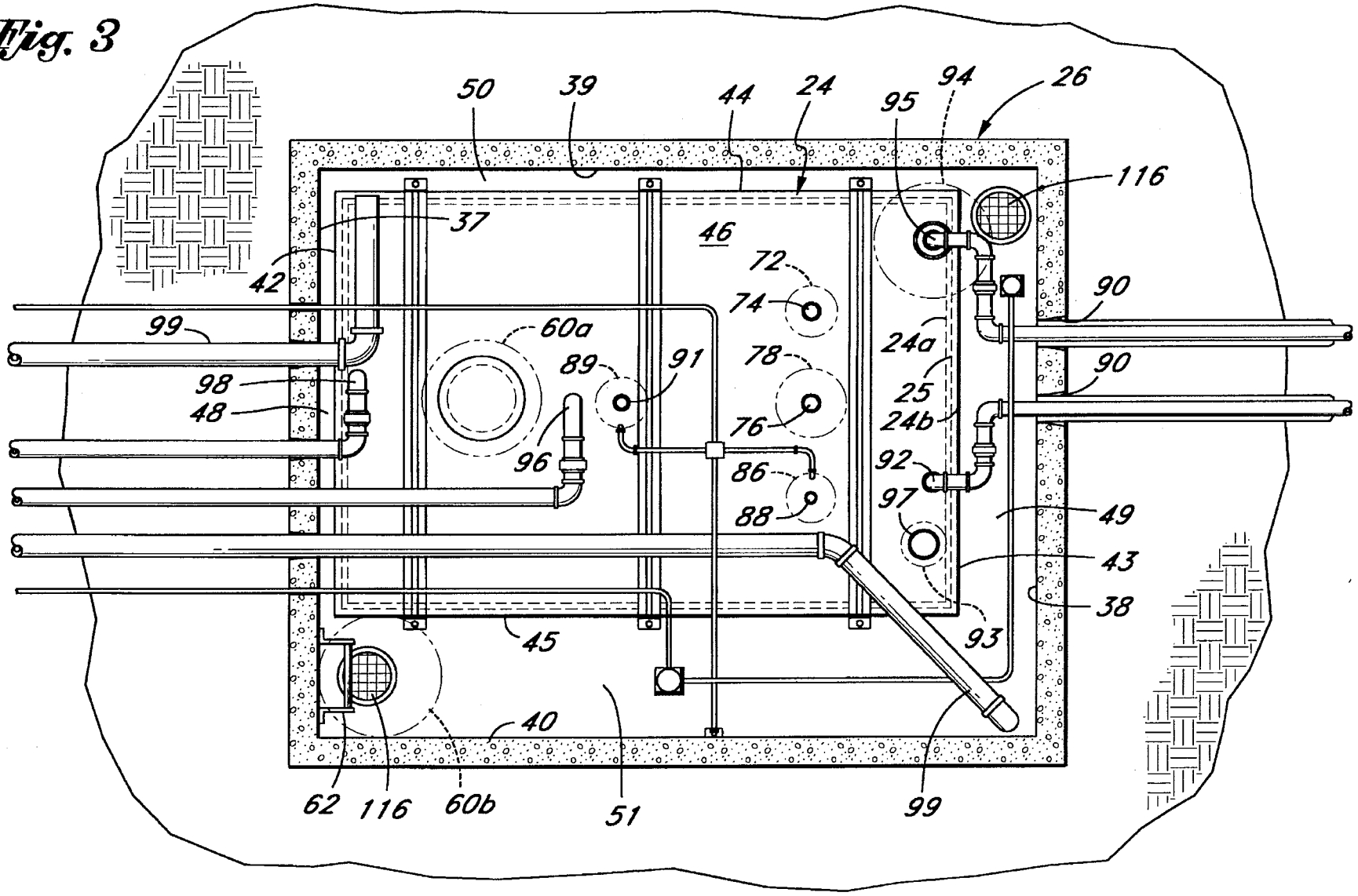
FIG. 3 is a sectional view of the system of FIG. 1 along line 3—3.

The components of a preferred underground vaulted storage system 20 of the present invention are shown in FIGS. 1–3. The vaulted underground storage system 20 is designed to be buried within an excavated hole 22, previously dug out, with the side walls sloped or shored up as required. The bottom floor of the excavated hole will be a uniformly graded subgrade providing a flat horizontal surface on which to place the vaulted tank system 20. Subsequent to the installation of the vaulted tank system 20, an amount of granular compacted backfill will be added between the vault and the excavated cavity 22 for support.

The underground vaulted tank storage system 20 generally comprises a toxic or other liquid storage vessel or tank 24 and an outer containment vault 26. The vault 26 is comprised of a bottom unit 28, one or more collar units, and a cover or lid 34. In the illustrated embodiment, the vault 26 includes a middle collar unit 30 and a top collar unit 32. The concrete vault 26 provides a box-shaped containment vessel for box-shaped tanks 24. In this description, both the tank 24 and vault 26 are box-shaped, or rectangular parallelepipeds. The vault 26 both retains the surrounding earth and provides an access space for visual inspection and/or repair of the tank.

Referring to FIGS. 2 and 3, when assembled the box-shaped containment vault 26 includes a bottom floor 36, a first upstanding wall 37, a second upstanding wall 38 opposite the first upstanding wall, a third upstanding wall 39, a fourth upstanding wall 40 opposite the third upstanding wall, and the aforementioned lid 34. The walls of the vault 26 are all rectangular, with their edges joined at right angles, thus forming the aforementioned parallelepiped shape. The storage tank 24 similarly comprises a bottom 41, a first upstanding side 42, a second upstanding side 43 opposite the first upstanding side, a third upstanding side 44, a fourth upstanding side 45 opposite the third upstanding side, and a top 46. The sides and corners of the tank 24 are likewise rectangular and right angled, respectively.

The storage tank 24 is placed within the vault 26 so that both the vault first wall 37 and tank first side 42, and the vault third wall 39 and the tank third side 44, are in close proximity. A larger clearance space exists between the vault second wall 38 and tank second side 43, and between the vault fourth wall 40 and tank fourth side 45. Additionally, a vertical clearance space 52 exists between the top 46 of the tank and the lower surface of the lid 34. A number of parallel spacers 54 are placed underneath the tank 24 to provide a bottom gap 55 between the tank and the bottom floor 36 of sufficient size to at least permit visual inspection of the portion of the bottom floor 36 beneath the tank 24, if not visual inspection of the tank bottom 41, itself. Desirably, the bottom gap 55 is between two and six inches and preferably the bottom gap 55 is approximately two inches. Advantageously, these spacers comprise lengths of channel iron or steel, welded to the tank bottom 41.

Together, bottom unit 28, middle collar unit 30, top collar unit 32 and lid 34 define an interior rectangular parallelepiped cavity within which the storage tank 24 is positioned. The tank rests on the bottom unit 28 and is positioned proximate one corner thereof. Advantageously, the size of the tank 24 is such that a vertical space exists between the top of the tank to the lid 34, as seen in FIG. 2. In addition, desirably the vault 26 and tank 24 cooperate to form an L-shaped access space adjacent the two tank sides 43, 45 which join opposite the corner of the vault that the tank is placed, as seen in FIG. 3.

As shown in FIG. 2, the bottom unit 28 and middle collar unit 30 meet at a stepped junction 29 providing a means for positioning the upper unit with respect to the lower unit.

Likewise, the middle collar unit 30 and top collar unit 32 meet at a stepped junction 31, and the top collar unit 32 and lid 34 meet at a stepped junction 33. Preferably, the abutting surfaces at the junctions 29, 31 and 33 are sealed together to water seal the vault 26 and provide a secondary containment vessel. Desirably, an sealant such as RAM-NEK fills the cracks between the units at the junctions 29, 31 and 33. Additionally, a sheet of material such as, for example, Hypalon by Dupont may be epoxied across the interior joint of the junctions 29, 31 and 33, providing a sufficient seal for fuel containment.

Referring to FIGS. 2–3, the underground tank storage system 20 may be installed at a retail gasoline service station such that the lid 34 is flush with the surrounding pavement 58. The lid 34 provides a safe driving surface due to its sturdy steel-reinforced concrete construction. The lid 34 desirably includes one or more gasketed man-way covers 60 through which a service technician may obtain access to the interior of the vault 26.

In the preferred embodiment, the lid 34 includes a man-way cover **60*a* positioned above the top of the storage tank 24, and a second man-way cover 60*b* positioned proximate the corner of the vault 26 and over the clearance gap 51. A galvanized steel access ladder 62 descends from the second man-way cover 60*b* down the first vault side wall 37 to the bottom floor 36 of the vault. Desirably, the tank 24 includes a man-way 64 positioned directly below the first man-way cover 60*a* of the vault 26. Preferably, the tank man-way 64 consists of a lower flange piece 66 and an extension piece 68. The lower flange piece 64 is preferably formed integrally with the tank 24 and has a height of six inches above the top 46 of the tank. The extension piece 68 has a height sufficient to substantially span the upper space 52 and includes flanges 70 on either end to couple with the lower flange piece 66 and the first man-way cover 60*a*** in a manner well known in the art.

Desirably, the vertical clearance space 52 between the tank 24 and the lid 34 is sufficient to accommodate tank piping and connections to the tank top 46, advantageously avoiding such connections protruding from the sides of the tank which would necessitate an increase in vault size and risk draining the tank contents into the vault if a piping failure occurred. Desirably, the clearance space 52 has a height of between 12" and 36", and preferably the clearance space has a height of approximately 24".

Several other access ports provide communication with the interior of the vault 26 through the lid 34. A 12-inch diameter gasketed access cover 72 provides a port for a 4-inch diameter vapor return pipe extending up from a connection 74 in the tank top surface 46. A second 12-inch gasketed cover 86 provides access to a 2-inch diameter secondary container sensor pipe extending up from a connection 88 on the top of the tank. A third 12-inch diameter gasketed cover 89 provides access to a 4-inch diameter tank level pipe extending up from a connection 91 in the tank top surface 46. A fourth 12-inch diameter gasketed cover 93 provides access to a 6-inch diameter secondary containment emergency vent pipe extending up from a connection 97 in the top of the tank. A second 30-inch diameter gasketed man-way cover 94 provides access to a 6-inch diameter suction or supply pipe 95.

An approximately 18-inch diameter gasketed overfill containment cover 78 provides access to a 4-inch diameter fill tube, which extends down to a connection 76 on the tank 24 as a main filling conduit. An overfill containment well 80 depends from underneath the overfill cover 76, and an overfill nipple 82 opens into the well 80. The overfill nipple 82 joins to an elbow-configured pipe 84, which communicates with the interior of the fill tube 78. When the tank 24 is filled with fluid via the fill tube 78, the overfill nipple 82 alerts the technician that the maximum capacity has been reached prior to any fluid spilling from the tank man-way cover **60*a*. The open end of the nipple 82 is at a lower elevation than the cover 60*a* and thus the technician will observe fluid spilling from the nipple and into the containment well 80 signalling that the tank 24** is full and will shut off the fluid flow prior to the fluid level reaching the man-way cover.

Various other pipes extend upward from the tank 24 and bend to exit the vault via several aligned apertures 90 disposed approximately 10 inches below the lid 34 on the top collar 32 to thereafter communicate with external monitors, pipes, pumps or vents. Such pipes include a 2-inch diameter vapor return line 92, a 3-inch diameter primary tank vent pipe 96 and a 3-inch diameter secondary tank vent pipe 98. Several optional vault air supply pipes 99 extend through the collar 32 and into the inner space of the vault. The apertures 90 are initially cast into the collar 32 as dead-end knockouts which provide a partially formed aperture having a thin outer wall. After installation of the entire vault 26, the appropriate knockouts are punctured to form the apertures 90.

In the preferred embodiment, the upstanding walls 37, 38, 39 and 40 comprise slabs of steel reinforced precast concrete having a density of approximately 4,050 pounds per cubic yard. Desirably, the walls are constructed with one or more reinforcing steel mats (not shown), the steel complying with ASTM A615 grade 60 or ASTM A706 grade 70 and the bending and placement complying with ACI standards. The thickness of the walls may vary between 4 and 12 inches, and is desirably 8 inches thick. In one embodiment, the interior vault dimensions are 15 feet from the first wall 37 to the second wall 38, and 12 feet from the third wall 39 to the fourth wall 40. Consequently, the exterior width of the third or fourth walls 39, 40, is 16'4" and the exterior width of the first and second walls 37, 38 is 13'4".

Looking from above, as in FIG. 3, the storage tank 24 is situated within the vault 26 creating a first visual inspection gap 48 between the vault first wall 37 and tank first side 42 sufficiently wide to permit visual inspection of the first side 42 of the tank, and is desirably wide enough to meet existing visual inspection standards. A second visual inspection gap 50 is formed between the vault third wall 39 and tank third side 44, sufficiently wide to permit visual inspection of the third side 44 of the tank 24 and desirably wide enough to meet existing visual inspection standards. A first physical access gap 51 between the vault fourth wall 40 and tank fourth side 45 is sufficiently large to meet standard access requirements. The first physical access gap 51 permits physical access between the vault fourth wall 40 and the tank fourth side 45, and is desirably wide enough to enable an inspector to climb down the ladder 62 and check the fourth tank wall for leaks, as well as visually inspect along the first tank wall 37 via the first visual inspection gap 48. A second physical access gap 49 between the vault second wall 38 and tank second side 43 is sufficiently wide to permit visual inspection of the tank second wall and is desirably wide enough to meet existing access standards. The second physical access gap 49 allows an inspector to check the second tank wall for leaks, as well as visually inspect the third tank wall 44 via the second visual inspection gap 50.

Advantageously, the bottom 41 may be visually checked for leaks via the bottom gap 55 by an inspector located in the first physical access gap 51 or in the second visual inspection gap 50.

The position of the tank 24 within the vault 26 provides an important advantage, in that all four sides of the tank may be inspected visually without unduly enlarging the outer containment vault. Indeed, the provision of space along two sides for physical access, and space along the other two sides only for visual access, creates a highly efficient tank storage container. Desirably, the tank 24 is situated such that the first visual inspection gap 48 between the vault first wall 37 and tank first side 42 is between 2" and 10" wide, and preferably the gap 48 is 6" wide. Desirably, the second visual inspection gap 50 between the vault third wall 39 and tank third side 44 is between 2" and 10" wide, and preferably the gap 50 is 6" wide. The first physical access gap 49 between the vault second wall 38 and tank second side 43 is desirably between 12" and 30" wide. Preferably the first physical access gap 49 is between 18" and 24" and, more preferably, the gap is 18" wide. In addition, the second physical access gap 51 between the vault fourth wall 40 and tank fourth side 45 is desirably between 20" and 40" wide, and preferably is 30" wide.

An important aspect of the invention is the provision for a range of storage capacities of the tank 24 by virtue of varying vertical heights of the tank and vault 26. In this regard, the horizontal cross-sectional dimensions, may be standardized, lowering manufacturing costs, and the differences in tank capacities be accommodated by varying the vertical height of the tank 24 and vault 26. Desirably, the tank capacity is between 4,000 and 10,000 gallons, but the features of the present invention are suitable for storing tanks of other capacities.

With reference to FIGS. 1 and 2, the bottom unit 28 comprises a pan or cup-shaped rectangular member having vertical side wall portions comprising the bottom portion of the upstanding vault walls 37, 38, 39 and 40. The size of the bottom unit 28 is desirably the same for each of the standard tank storage capacities discussed below. The bottom unit 28 is preferably pre-fabricated from steel-reinforced precast concrete and has wall thickness of sufficient strength to withstand the loading of the exterior earth. The interior and exterior dimensions of the side wall portions of the bottom unit 28 correspond to those previously described for the side walls. Thus, the exterior dimensions of the bottom unit are between 5 and 15 feet on one side and between 10 and 22 feet on the opposite side, allowing the unit to be transported lengthwise on the back of a lightweight truck trailer rig, and obviating the need for the hiring of an escort truck. The bottom unit 28 comprises the largest section of the entire vault 26 and has a dry weight which generally enables the bottom unit to be transported without acquiring expensive shipping permits, as is commonly required in most states.

The bottom unit 28 has a bottom plate 36 with vertical side wall portions of steel-reinforced concrete. The interior side wall portions of the bottom unit 28 in all the following examples preferably extend 4 feet above the upper surface of the bottom 41. The bottom plate 36 and side wall portions are of a sufficient thickness to provide structural strength against exterior forces of the surrounding earth, and more desirably, comply with American Association of State Highway and Transportation Officials (AASHTO) HS-20 loading standards. Preferably, the bottom plate 36 is 9 inches thick and the side wall portions are 8 inches thick. The exterior dimensions of the bottom unit 28 are preferably 13'-4" on one side and 16'-4" on the opposite side. The bottom unit 28 preferably has a dry weight of approximately 47,000 lbs, or 23 tons.

Desirably, the storage tank 24 of the present invention is fabricated in a number of standard volumetric capacities utilizing some interchangeable parts. In this regard, the various sized tanks 24 all have the same horizontal dimensions but have different heights corresponding to the specific storage capacity. The tanks 24 are welded from sheet steel and thus the top 46 and bottom 41 sheets are the same size for all the tanks. In addition, the position of the piping connections on the top 46 of the tank are desirably identical each tank size. Furthermore, reinforcement ribs for the top 46 and bottom 41 are desirably interchangeable.

The preferred storage tank 24 desirably has a width along the first and second sides 42, 43 of between 100 and 120 inches and preferably 110 inches, and a length along the third and fourth sides 44, 45 desirably between 150 and 170 inches, and preferably 158 inches. The height of the tanks 24 will be described below for specific volumetric capacities.

Referring to FIG. 3, two 12-inch diameter round plastic catch-all sumps 116, approximately 3–4 inches deep, are desirably cast into the concrete bottom unit 28 at the corners joining the first and fourth vault walls 37, 40 and the second and third vault walls 38, 39. Any leakage from the tank 24 will advantageously drain to the sumps for easy removal.

The present invention reduces the total paving area required by acting as its own driving surface. The lid 34 is desirably designed in full compliance with the AASHTA existing standard specifications for highway bridges utilizing HS-20-44 loading with 30% impact factors. Because of the present invention's single-piece removable lid 34, hard-to-seal non-compressed leak-prone joints are eliminated and joint bumps are minimized in traffic areas.

The present vault is designed for 100% float-up resistance with ground water saturation to the finish grade elevation by optionally providing steel dowel bars 112 cast into the sides of the bottom unit for anchoring into the field ballast concrete slab extensions 114, which are cast abutting the undisturbed excavation cavity 22. Additionally, the internal steel tank 24 is anchored to the floor 36 to satisfy earthquake code requirements and resist internal tank float-up and associated piping damage should vault flooding occur.

10,000-Gallon Capacity Tank

In one embodiment, the tank 24 comprises a 10,000-gallon capacity Underwriter Laboratories (UL) listed tank with an optional UL-listed integral secondary containment tank. The outer walls of the vault 26 consist of the 4-foot tall side wall portions of the bottom unit 28, a 5-foot high square tubular middle collar 30 and a 5-foot tall square top collar 32, for a total height of 14 feet from the bottom 36 to the lid 34. The tank is approximately 11'8" tall, and thus a 20-inch long tank man-way extension piece 68 to reach from the lower flange piece 66 to the first vault man-way cover **60*a* is required. The total volume inside the vault 26 is approximately 2,520 $ft^3$, and the volumetric capacity of the tank is approximately 1,337 $ft^3$, resulting in a liquid storage space usage of approximately 53% within the vault. The total dry weight of the 10,000-gallon capacity storage vault 26** is approximately 128,384 pounds, or the equivalent weight of approximately 31.7 cubic yards of concrete.

8,000-Gallon Capacity Storage Tank

In another embodiment, the UL-listed tank 24 has a storage capacity of 8,000 fluid U.S. gallons. The 8,000-gallon storage capacity vault 26 comprises a bottom unit 28 with 4 foot tall side wall portions, as described before, a 5-foot tall square tubular middle collar 30, a 3-foot tall square tubular top collar 32, and the previously described lid 34. The approximate height of the tank above the bottom floor 36 is approximately 9'8", leaving a gap between the top 46 of the tank and the lid 34 of approximately 30 inches. Thus, the tank man-way extension piece 68 is approximately 24 inches long. The approximate volume inside the vault is 2,160 $ft^3$, and the volume of fluid corresponding to 8,000 gallons is 1,070 $ft^3$, resulting in a liquid storage space usage of approximately 50%. The total dry weight of the 8,000-gallon storage capacity vault 26 is approximately 117,000 pounds, or the equivalent weight of 28.9 cubic yards of concrete.

6,000-Gallon Storage Capacity Tank

Figure 4:
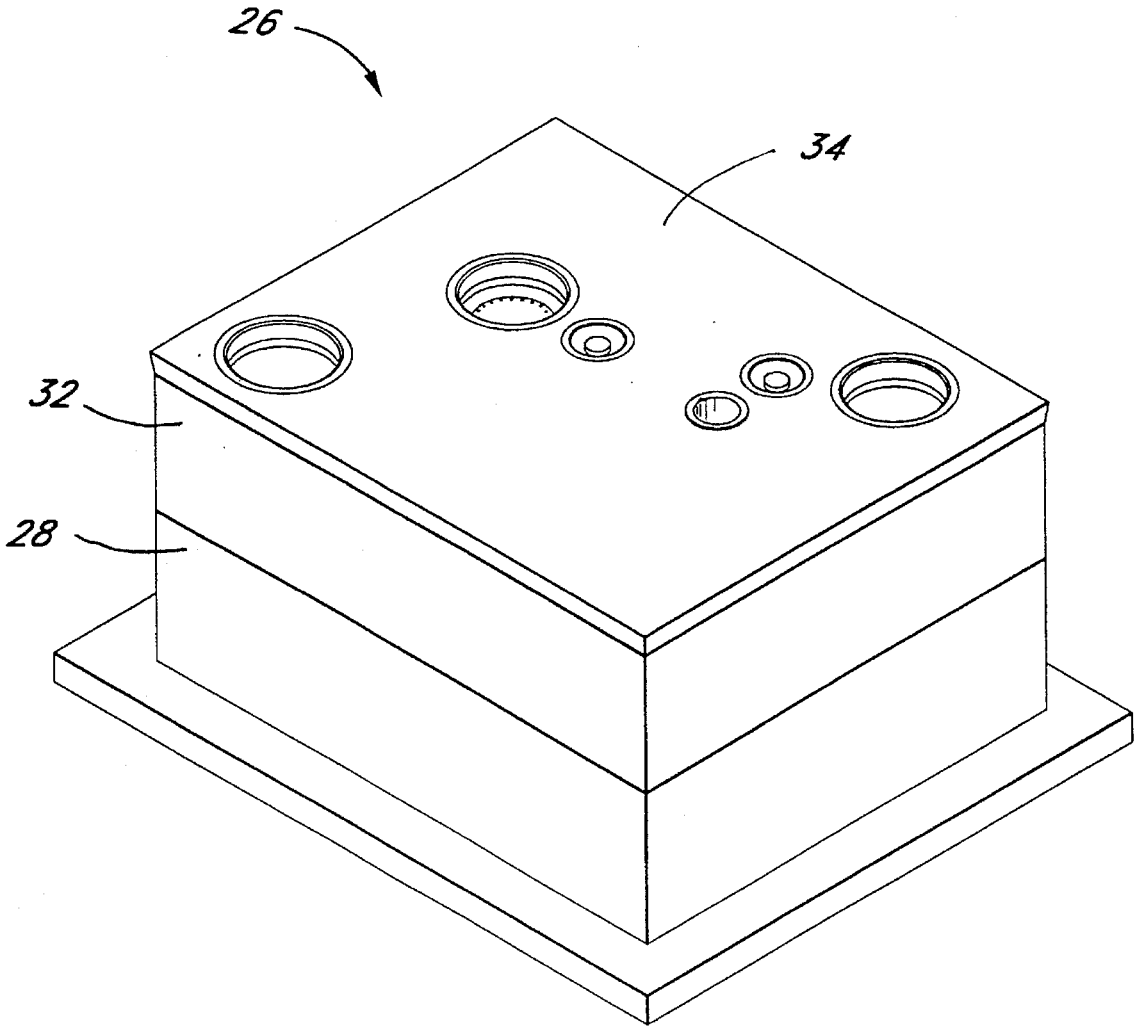
FIG. 4 is a partial cutaway perspective view of an underground storage tank and vault system of the present invention having a vault in three sections.

In a further embodiment, the UL-listed storage tank 24 comprises a 6,000-gallon storage capacity having a height of approximately 7'4" above the floor 36. The vault 26 comprises the aforementioned bottom unit 28 with 4-foot tall side wall portions and only one other section in addition to the lid 34, a 5-foot tall square tubular top collar 32. Such a vault 26 having only three sections is shown in FIG. 4. Thus, the space between the top 46 of the tank and lid 34 is approximately 20 inches, requiring a tank man-way extension piece 68 of 14 inches. The volume inside the vault is 1,620 $ft^3$ and the volume of fluid is 802 $ft^3$, resulting in a liquid storage space usage of approximately 50%. The total dry weight of the assembled vault 26 is approximately 100,000 pounds, or the equivalent weight of 24.7 cubic yards of concrete.

4,000-Gallon Storage Capacity Tank

In still a further embodiment, the storage capacity of the UL-listed tank 24 is approximately 4,000 gallons. The vault 26, of which FIG. 4 is representative, comprises a bottom unit 28 and a 3-foot tall square tubular top collar 32, for a total of 7 feet from the bottom 36 to the lid 34. The tank 24 has an approximate height of 5 feet, requiring an 18-inch long tank man-way extension piece 68. The volume inside the vault 26 is approximately 1,260 $ft^3$, while the volume of fluid is equivalent to 535 $ft^3$, resulting in a liquid storage space usage of approximately 42%. The total dry weight of the vault 26 is approximately 89,000 pounds, or the equivalent weight of 21.9 cubic yards of concrete.

All of the above-mentioned sizes of vaulted storage tanks may be constructed in a number of ways known for preventing ingress of ground water and egress of fuel or toxic liquid from the vault 26. For a 10,000 gallon capacity tank, the total weight of the tank is 7000 lbs, a relatively small proportion of the overall weight of the system. In the simplest embodiment, the primary tank comprises a ¼-inch thick welded steel container with no secondary tank and the vault 26 is water sealed at the joints to prevent ground water intrusion. In a second embodiment, still with only a primary tank 24, the vault 26 is sealed to prevent ground water intrusion and is also sealed on the interior side of the joints with a previously mentioned Hypalon or other material strip to provide 150% secondary fuel containment. The percentage for secondary fuel containment refers to the volume capacity of the secondary container with respect to the primary container volume. In a still further embodiment utilizing a single primary tank 24, the vault is sealed to prevent ground water intrusion and also provided with a cast-in poly liner to provide 150% secondary fuel containment.

As illustrated in FIG. 3, the tank 24 comprises a ¼-inch thick primary tank **24*a* with a 3/16-inch outer secondary tank 24*b* separated from the primary tank with a 3/16-inch gap 25. The vault 26 is sealed at the joints to prevent ground water intrusion and also provided with a cast-in polyliner 27 to provide 150% tertiary containment. The poly liner 27 is cast separately into the respective vault sections 28, 30 and 32 whereupon strips 35 of Hypalon or other material seal the joints between the liners. Alternatively, the tank 24** comprising a primary and secondary tank may be placed in a vault which is sealed to prevent ground water intrusion and strips of Hypalon or other material sealed across the joints to provide 150% tertiary containment.

Figure 5:
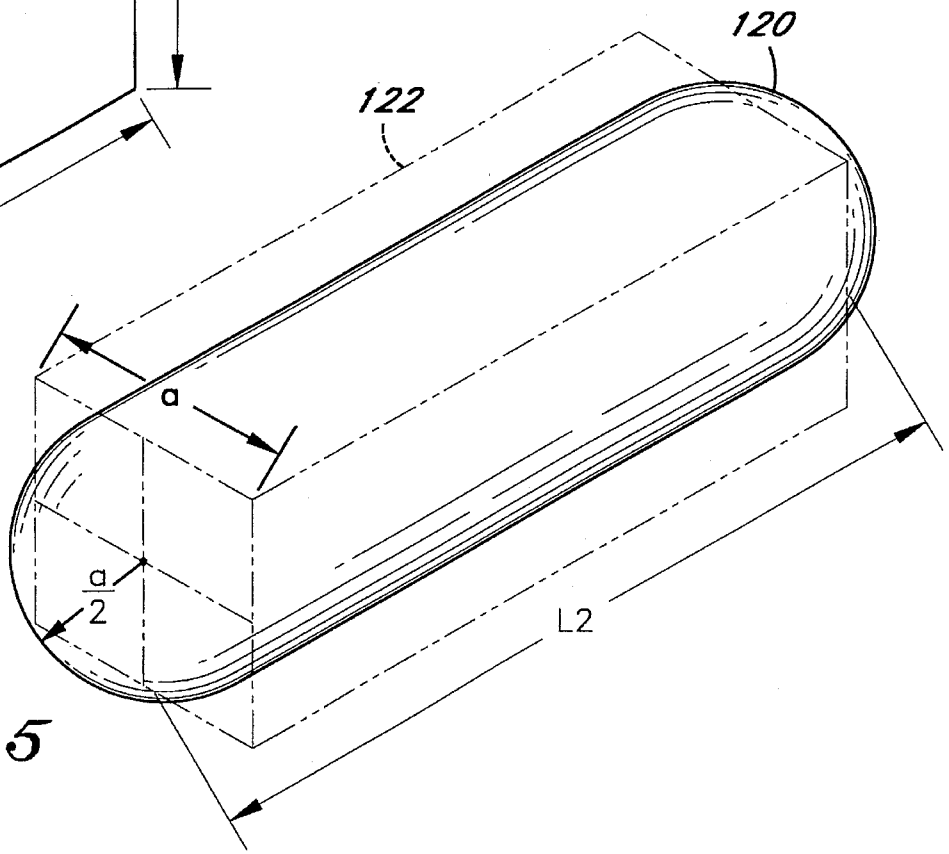
FIG. 5 is a schematic representation of a tubular storage tank of the prior art.
Figure 6:
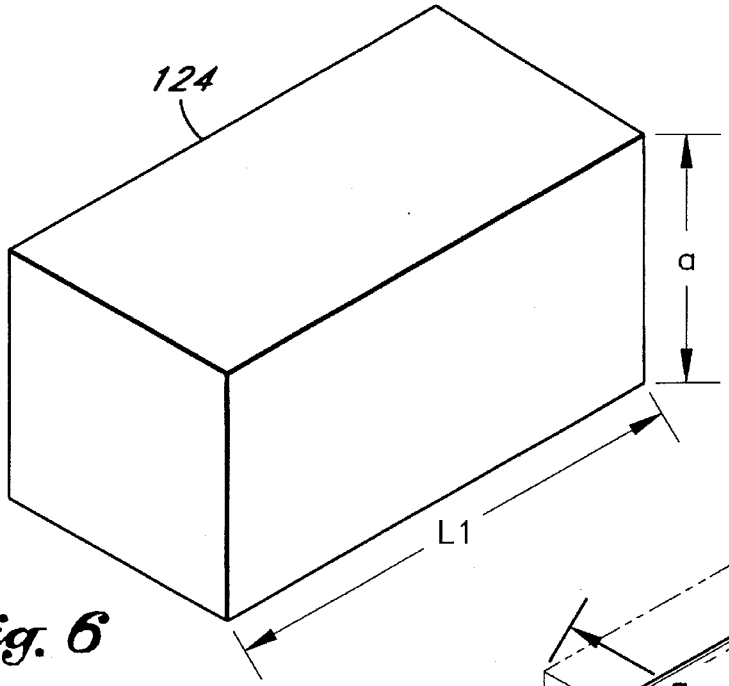
FIG. 6 is a schematic representation of a rectangular storage tank.

FIG. 5 illustrates a tubular volume 120 longitudinally aligned within a rectangular parallelepiped volume 122, shown in phantom. FIG. 6 shows a rectangular parallelepiped 124 having the same volume as the tube 120. The tubular volume 120 represents a typical shape of a liquid storage tank of the prior art and comprises a central tubular portion of diameter a, terminating in two hemispherical end caps of diameter "a". The total length of the tubular volume 120 is $L_2$. The rectangular volume 124 represents the preferred storage tank configuration of the present invention comprising a square cross section of sides of width a and with a length $L_1$. The length of the two volumes will be compared below for different storage capacities. Due to the fact that the cross-sectional projections are equal, the relative size of a containment vault for each of the two shaped tanks depends on their relative lengths.

EXAMPLE 1

If, for example, the storage capacity of the tanks 120, 124 is 10,000 gallons. This translates into a volume of approximately 1346 $ft_3$. Assuming that the dimension "a" is 8 feet, the length $L_1$ will be 21.0 feet, and the length L2 will be 29.4 feet. Now assume that a storage vault encloses the tanks and a total clearance of 24 inches at the ends and 36 inches at the horizontal sides is provided—thus meeting the minimum OSHA physical and visual access clearance requirements. No clearance is assumed at the top and bottom.

Assuming the vault has an 8 inch wall thickness, the outer dimensions of the vault around the tubular tank 120 are thus approximately 32.8 feet long by 12.3 feet across and 9.3 feet tall. The outer dimensions of the vault around the rectangular tank 124 are thus 24.3 feet long by 12.3 feet across and 9.3 feet tall, or at least 34% shorter than the vault for the tubular tank having the identical capacity. Assuming the concrete has a dry weight density of 100 lbs per ft3, the volume of concrete necessary to vault the tubular tank is approximately 1004 ft3, and the total dry weight thus is 104,000 lbs. The volume of concrete necessary to store the rectangular tank 124 is approximately 777 $ft^3$ and the total weight is 77700 lbs, or 22,700 pounds less than the vault for the tubular tank having the identical capacity. Not only does the design of the present invention save on concrete and transportation costs, however, dues to its smaller size, it requires less dirt to be excavated. Assuming a cavity to receive the vault is 1 foot wider an all sides and the same depth, a hole for the rectangular tank vault requires 4950 $ft^3$ of dirt to be excavated, as opposed to 3740 $ft^3$ of dirt as required by the tubular design. Assuming an average dirt weight of 100 $lbs/ft^3$, this is 121,000 lbs. less dirt to be excavated.

EXAMPLE 2

If the storage capacity of the tanks 120, 124 is 8,000 gallons, or a storage volume of approximately 1073 ft3, the length $L_1$ will be 16.8 feet, and the length $L_2$ will be 24.0 feet. A storage vault enclosing the tanks having a total clearance of 24 inches at the ends and 36 inches at the horizontal sides and no clearance at the top and bottom is provided.

Assuming the vault has an 8 inch wall thickness, the outer dimensions of the vault around the tubular tank 120 are thus 27.3 feet long by 12.3 feet across and 9.3 feet tall. The outer dimensions of the vault around the rectangular tank 124 are thus 20.1 feet long by 12.3 feet across and 9.3 feet tall, or over 35% shorter than the vault for the tubular tank having the identical capacity. Assuming the concrete has a dry weight density of 100 lbs per ft3, the volume of concrete necessary to vault the tubular tank is approximately 858 ft3, and the total dry weight thus is 85,800 lbs. The volume of concrete necessary to store the rectangular tank 124 is approximately 663 $ft^3$ and the total weight is 66,300 lbs, or 19,500 pounds less than the vault for the tubular tank having the identical capacity. Assuming a cavity to receive the vault is 1 foot wider an all sides and the same depth, a hole for the rectangular tank vault requires 3140 $ft^3$ of dirt to be excavated, as opposed to 4270 $ft^3$ of dirt as required by the tubular design. Assuming an average dirt weight of 100 $lbs/ft^3$, this is 113,000 lbs. less dirt to be excavated.

The resulting amounts of concrete necessary to enclose both a tubular tank 120 and rectangular tank 124 are shown in tabular form below for the preceding examples.

| | Tank Volume, $ft^3$ | Tank Length, ft | Vault Length, ft | Vault Weight, lbs |
|---|---|---|---|---|
| | Tank Capacity Equals 10,000 Gallons | | | |
| System of the Preferred Embodiment | 1346 | 21.0 | 24.3 | 77700 |
| System using tubular tank 120 | 1346 | 29.4 | 32.8 | 100400 |
| | Tank Capacity Equals 8,000 Gallons | | | |
| System of the Preferred Embodiment | 1073 | 16.8 | 20.1 | 66300 |
| System using tubular tank 120 | 1073 | 24.0 | 27.3 | 85800 |

In two further examples, the storage capacity of the tanks are 4,000 and 6,000 gallons. The resulting amounts of concrete necessary to enclose both a tubular tank 120 and rectangular tank 124 are shown below in tabular form.

EXAMPLE 3

| | Tank Volume, $ft^3$ | Tank Length, ft | Vault Length, ft | Vault Weight, lbs |
|---|---|---|---|---|
| | Tank Capacity Equals 4,000 Gallons | | | |
| System of the Preferred Embodiment | 546 | 8.5 | 11.8 | 43800 |
| System using tubular tank 120 | 546 | 13.5 | 16.8 | 57400 |

EXAMPLE 4

| | Tank Volume, $ft^3$ | Tank Length, ft | Vault Length, ft | Vault Weight, lbs |
|---|---|---|---|---|
| | Tank Capacity Equals 6,000 Gallons | | | |
| System of the Preferred Embodiment | 819 | 12.8 | 16.1 | 55460 |
| System using tubular tank 120 | 819 | 19.0 | 22.3 | 72300 |

It is apparent that as the storage capacity increases, the amount of concrete needed to enclose the rectangular volume 124 provides a great savings over the amount necessary to enclose the tubular volume 120. This demonstration, although somewhat abstract, illustrates the efficient use of fluid storage capacity of the rectangular shape of the present invention in underground storage applications. In every example, the projected size of the rectangular volume 124 is smaller than the tubular volume 120, but the volumetric storage capacity is the same. In short, in comparison to standard vaulted tubular tank systems, the present vaulted storage system uses less concrete and less land area, has a lower transported weight and permits the use of a smaller installation crane.

In addition, as noted previously, the minimum volume of earth required to be excavated is smaller for the rectangular volume 124. The minimum volume of earth required to be excavated for each comprises at least the outer volume of the concrete storage vault and, in practice, at least one foot around the sides of the vault to a predetermined depth equal to the height of the vault if the top is to be flush with the surrounding grade. Thus, the reduced length of the vault needed to store the rectangular tank 124 produces a substantial reduction in excavation size, time to excavate and associated cost.

To illustrate an example using existing vaults, the following table compares a preferred form of the storage system 20 of the present invention with a typical storage system manufactured by SUREVAULT. Both tanks store slightly more than 10,000 gallons, the example of the present invention having a capacity of 10,065 gallons and the SUREVAULT tank a capacity of 10,500 gallons. Both vaults are fabricated from steel-reinforced pre-cast concrete. The SUREVAULT design has external dimensions of 31'-8" long by 12'-0" wide by 5"-2.5" tall, while the preferred embodiment has external dimensions of 16'-4" long by 13'-4" wide by 15'-6" tall.

| | Largest Dimension (Length) | Largest Vault Section Approximate Weight | Total Vault Approximate Weight |
|---|---|---|---|
| | 10,000 Gallon Storage Tank Vault | | |
| SUREVAULT | 31'–8" | 79,300 lbs | 175,660 lbs |
| Preferred Embodiment | 16'–4" | 47,200 lbs | 128,600 lbs |
| Absolute Savings | 15'–4" | 32,100 lbs | 47,060 lbs |
| Percent Savings | 48% | 40% | 26% |

Thus, the vault of the preferred embodiment of the underground storage system is 47,060 pounds lighter than the vault of the SUREVAULT system. This represents not only a substantial savings in concrete costs to manufacture the unit, but because the largest section of the vault weighs only 47,200 pounds (32,100 pounds less than the largest SUREVAULT vault section), smaller, less expensive cranes can be used to install the system and the need for transportation permits can be minimized. Notably, the largest dimension of the vault of the preferred embodiment is 15'4" shorter than that of the SUREVAULT design. This is critical as it allows the system to be installed in locations where a comparable capacity SUREVAULT or other prior art system could not, either due to restrictive easements or other considerations.

Although this invention has been described in terms of certain preferred embodiments, other embodiments that are apparent to those of ordinary skill in the art are also within the scope of this invention. Accordingly, the scope of the invention is intended to be defined only by the claims which follow.

What is claimed is:

1. An underground storage system, comprising:

a vault substantially buried in the ground, comprising:

a generally rectangular bottom;

a first pair of opposing upstanding walls;

a second pair of opposing upstanding walls, said bottom, said first pair of walls and said second pair of walls comprising concrete and cooperating to form a box-shaped container having an open upper end, a generally rectangular horizontal cross-section and a generally rectangular vertical cross-section; and a top covering said open upper end, said top defining an opening sized and shaped such that an adult can pass through said opening;

a storage vessel for containing liquids, said storage vessel comprising:

a top;

a bottom;

a first pair of opposing upstanding sides; and a second pair of opposing upstanding sides, said storage vessel having a generally rectangular horizontal cross-section and a generally rectangular vertical cross-section; and, spacers supporting said bottom of said storage vessel above said bottom of said vault, wherein said vault is sized and shaped and said vessel is positioned within said vault such that there is sufficient space between said storage vessel and said vault such that an adult can enter said vault through said opening in said top of said vault and move along at least two of said walls between said vessel and said vault to visually inspect each of said sides of said storage vessel and said bottom of said vault.

2. The underground storage system of claim 1, wherein said vault and said vessel cooperate to form a first physical access gap between a first of said walls and a first of said sides of between 20 and 40 inches.

3. The underground storage system of claim 2, wherein said vault and said vessel cooperate to form a second physical access gap between a second of said walls and a second of said sides of between 12 and 30 inches.

4. The underground storage system of claim 3, wherein said vault and said vessel cooperate to form a second physical access gap between a second of said walls and a second of said sides of between 18 and 24 inches.

5. The underground storage system of claim 4, wherein said vault and said vessel cooperate to form a first visual inspection gap between a third of said walls and a third of said sides of between 2 and 10 inches.

6. The underground storage system of claim 5, wherein said vault and said vessel cooperate to form a second visual inspection gap between a fourth of said walls and a fourth of said sides of between 2 and 10 inches.

7. The underground storage system of claim 6, wherein said vault and said vessel cooperate to form a vertical clearance space between said top of said vault and said top of said vessel, having a height of between 12 and 36 inches.

8. The underground storage system of claim 7, wherein said storage vessel comprises a storage capacity of approximately 10,000 gallons and the overall dimensions of said vault are approximately 16 feet, 4 inches on one side, approximately 13 feet, 4 inches on a second side, and approximately 15 feet, 6 inches in height.

9. The underground storage system of claim 7, wherein said storage vessel comprises a storage capacity of 8,000 gallons and the external dimensions of said vault comprise approximately 16 feet, 4 inches on one side, 13 feet, 4 inches on a second side, and a height of approximately 13 feet, 6 inches.

10. The underground storage system of claim 7, wherein said storage vessel comprises a storage capacity of 6,000 gallons and the external dimensions of said vault are approximately 16 feet, 4 inches on one side, 13 feet, 4 inches on a second side and approximately 10 feet, 6 inches in height.

11. The underground storage system of claim 7, wherein said storage vessel comprises a storage capacity of 4,000 gallons and said vault has external dimensions of approximately 16 feet, 4 inches on one side, 13 feet, 4 inches on a second side and approximately 8 feet, 6 inches in height.

12. The underground storage system of claim 7, wherein said vault bottom and said upstanding walls comprise:

a pre-fabricated cup-shaped bottom unit, comprising:

a generally rectangular bottom;

a first pair of generally opposing upstanding wall portions; and a second pair of generally opposing upstanding wall portions, said bottom, said first pair of wall portions and said second pair of wall portions comprising concrete and cooperating to form a box-shaped container having an open end, a generally rectangular horizontal cross-section and a generally rectangular vertical cross-section; and, at least one pre-fabricated collar unit, comprising:

a first pair of generally opposing upstanding wall portions; and a second pair of generally opposing upstanding wall portions, said first pair of wall portions and said second pair of wall portions comprising concrete and cooperating to form a box-shaped tube having an open upper end, an open lower end, a generally rectangular horizontal cross-section and a generally rectangular vertical cross-section.

13. The underground storage system of claim 12, wherein said storage vessel comprises a primary containment liner and a secondary containment liner.

14. The underground storage system of claim 13, wherein said primary and said secondary containment liners comprise welded sheet steel separated by a gap.

15. The underground storage system of claim 14, wherein said vault is sealed at junctions between said bottom unit and one of said collar units and between each of said collar units when there is more than one collar unit to prevent ground water intrusion.

16. The underground storage system of claim 1, wherein said vault has an interior capacity and said vessel has an interior capacity greater than 40 percent of the said interior capacity of said vault.

17. The underground storage system of claim 16, wherein said vault has an interior capacity and said vessel has an interior capacity greater than 50 percent of the said interior capacity of said vault.

18. An underground storage system, comprising:

a vault substantially buried in the ground, comprising:

a generally rectangular bottom;

a first pair of opposing upstanding walls;

a second pair of opposing upstanding walls, said bottom, said first pair of walls and said second pair of walls comprising concrete and cooperating to form a box-shaped container having an open upper end, a generally rectangular horizontal cross-section and a generally rectangular vertical cross-section; and a top covering said open upper end;

a storage vessel for containing liquids, said storage vessel comprising:

a top;

a bottom;

a first pair of opposing upstanding sides; and a second pair of opposing upstanding sides, said storage vessel having a generally rectangular horizontal cross-section and a generally rectangular vertical cross-section;

wherein said vault is sized and shaped and said vessel is positioned within said vault such that there is sufficient space between said storage vessel and said vault such that an adult can enter said vault through said top of said vault and move along at least two of said walls between said vessel and said vault to visually inspect each of said sides of said storage vessel.

19. The underground storage system of claim 18, wherein said vault and said vessel cooperate to form a first physical access gap between a first of said walls and a first of said sides of between 20 and 40 inches.

20. The underground storage system of claim 19, wherein said vault and said vessel cooperate to form a second physical access gap between a second of said walls and a second of said sides of between 12 and 30 inches.

21. The underground storage system of claim 20, wherein said vault and said vessel cooperate to form a second physical access gap between a second of said walls and a second of said sides of between 18 and 24 inches.

22. The underground storage system of claim 21, wherein said vault and said vessel cooperate to form a first visual inspection gap between a third of said walls and a third of said sides of between 2 and 10 inches.

23. The underground storage system of claim 22, wherein said vault and said vessel cooperate to form a second visual inspection gap between a fourth of said walls and a fourth of said sides of between 2 and 10 inches.

24. The underground storage system of claim 23, wherein said vault and said vessel cooperate to form a vertical clearance space between said top of said vault and said top of said vessel, having a height of between 12 and 36 inches.

25. An underground storage system, comprising:

a vault, comprising:

a pre-fabricated cup-shaped bottom unit, comprising:

a generally rectangular bottom;

a first pair of generally opposing upstanding wall portions; and a second pair of generally opposing upstanding wall portions, said bottom, said first pair of wall portions and said second pair of wall portions comprising concrete and cooperating to form a box-shaped container having an open end, a generally rectangular horizontal cross-section and a generally rectangular vertical cross-section; at least one pre-fabricated collar unit, comprising:

a first pair of generally opposing upstanding wall sections; and a second pair of generally opposing upstanding wall sections, said first pair of wall sections and said second pair of wall sections comprising concrete and cooperating to form a box-shaped tube having an open upper end, an open lower end, a generally rectangular horizontal cross-section and a generally rectangular vertical cross-section; and a pre-fabricated top, said top sized and shaped to cover said open upper end of said collar unit, wherein, when said vault is assembled, said bottom unit directly supports one of said at least one collar unit, and said wall portions and said wall sections cooperate to form a first pair and a second pair of walls;

a pre-fabricated storage vessel for containing liquids, said storage vessel comprising:

a top;

a bottom;

a first pair of opposing upstanding sides; and a second pair of opposing upstanding sides, said storage vessel having a generally rectangular horizontal cross-section and a generally rectangular vertical cross-section;

wherein said vault is sized and shaped, and said vessel is sized and shaped such that said vessel is positioned within said vault such that there is sufficient space between said storage vessel and said vault such that an adult can move along at least two of said walls between said vessel and said vault to visually inspect each of said sides of said storage vessel.

26. The underground storage system of claim 25, further comprising spacers capable of supporting said bottom of said vessel above said bottom of said vault, and wherein said vault is sized and shaped, and said vessel is sized and shaped such that said vessel is positioned so as to be supported by said spacers a sufficient distance above said bottom of said vault that said bottom of said vault beneath said bottom of said vessel can be visually inspected by an adult positioned between said vessel and said vault.

27. The underground storage system of claim 26, wherein said top defines an opening sized and shaped such that an adult can pass through said opening and said vault is sized and shaped and said vessel is sized and shaped such that said vessel is positioned relative said vault such that there is sufficient space between said storage vessel and said vault such that an adult can pass through said opening into said vault.

28. An underground storage system, comprising:

a vault substantially buried in the ground, comprising:

a pre-fabricated cup-shaped bottom unit, comprising:

a generally rectangular bottom;

a first pair of generally opposing upstanding wall portions; and a second pair of generally opposing upstanding wall portions, said bottom, said first pair of wall portions and said second pair of wall portions comprising concrete and cooperating to form a box-shaped container having an open end, a generally rectangular horizontal cross-section and a generally rectangular vertical cross-section;

at least one pre-fabricated collar unit, comprising:

a first pair of generally opposing upstanding wall sections; and a second pair of generally opposing upstanding wall sections, said first pair of wall sections and said second pair of wall sections comprising concrete and cooperating to form a box-shaped tube having an open upper end, an open lower end, a generally rectangular horizontal cross-section and a generally rectangular vertical cross-section; and a pre-fabricated top, said top covering said open upper end of said collar unit, wherein said bottom unit supports said collar unit and said top, and said wall portions and said wall sections cooperate to form a first pair and a second pair of walls;

a pre-fabricated storage vessel for containing liquids positioned within said vault, said storage vessel comprising:

a top;

a bottom;

a first pair of opposing upstanding sides; and a second pair of opposing upstanding sides, said storage vessel having a generally rectangular horizontal cross-section and a generally rectangular vertical cross-section;

wherein said vessel is positioned within said vault such that there is sufficient space between said storage vessel and said vault so that an adult can move along at least two of said walls between said vessel and said vault to visually inspect each of said sides of said storage vessel.

29. The underground storage system of claim 28, further comprising spacers supporting said bottom of said vessel above said bottom of said vault, and wherein said vessel is positioned so as to be supported by said spacers a sufficient distance above said bottom of said vault such that said bottom of said vault beneath said bottom of said vessel can be visually inspected by an adult positioned between said vessel and said vault.

30. The underground storage system of claim 29, wherein said top defines an opening sized and shaped such that an adult can pass through said opening and said vessel is positioned relative said vault such that there is sufficient space between said storage vessel and said vault such that an adult can pass through said opening into said vault.

31. The underground storage system of claim 30, wherein said vault and said vessel cooperate to form a first physical access gap between a first of said walls and a first of said sides of between 20 and 40 inches.

32. The underground storage system of claim 31, wherein said vault and said vessel cooperate to form a second physical access gap between a second of said walls and a second of said sides of between 12 and 30 inches.

33. The underground storage system of claim 32, wherein said vault and said vessel cooperate to form a second physical access gap between a second of said walls and a second of said sides of between 18 and 24 inches.

34. The underground storage system of claim 33, wherein said vault and said vessel cooperate to form a first visual inspection gap between a third of said walls and a third of said sides of between 2 and 10 inches.

35. The underground storage system of claim 34, wherein said vault and said vessel cooperate to form a second visual inspection gap between a fourth of said walls and a fourth of said sides of between 2 and 10 inches.

36. The underground storage system of claim 35, wherein said vault and said vessel cooperate to form a vertical clearance space between said top of said vault and said top of said vessel, having a height of between 12 and 36 inches.

37. The underground storage system of claim 36, wherein said storage vessel comprises a storage capacity of approximately 10,000 gallons and the overall dimensions of said vault are approximately 16 feet, 4 inches on one side, approximately 13 feet, 4 inches on a second side, and approximately 15 feet, 6 inches in height.

38. The underground storage system of claim 37, wherein said storage vessel comprises a storage capacity of 8,000 gallons and the external dimensions of said vault comprise approximately 16 feet, 4 inches on one side, 13 feet, 4 inches on a second side, and a height of approximately 13 feet, 6 inches.

39. The underground storage system of claim 37, wherein said storage vessel comprises a storage capacity of 6,000 gallons and the external dimensions of said vault are approximately 16 feet, 4 inches on one side, 13 feet, 4 inches on a second side and approximately 10 feet, 6 inches in height.

40. The underground storage system of claim 37, wherein said storage vessel comprises a storage capacity of 4,000 gallons and said vault has external dimensions of approximately 16 feet, 4 inches on one side, 13 feet, 4 inches on a second side and approximately 8 feet, 6 inches in height.

41. The underground storage system of claim 36, wherein said storage vessel comprises a primary containment liner and a secondary containment liner.

42. The underground storage system of claim 36, wherein said primary and said secondary containment liners comprise welded sheet steel separated by a gap.

43. The underground storage system of claim 36, wherein said vault is sealed at junctions between said units to prevent ground water intrusion.

44. The underground storage system of claim 36, wherein said vault has an interior capacity and said vessel has an interior capacity greater than 40 percent of the said interior capacity of said vault.

45. The underground storage system of claim 44, wherein said vault has an interior capacity and said vessel has an interior capacity greater than 50 percent of the said interior capacity of said vault.

46. A method of constructing an underground storage system, comprising:

excavating a hole in the ground of sufficient size to contain a vault of the desired capacity;

positioning within said hole a pre-fabricated cup-shaped bottom unit, comprising a generally rectangular bottom;

a first pair of generally opposing upstanding wall portions; and a second pair of generally opposing upstanding wall portions, said bottom, said first pair of wall portions and said second pair of wall portions comprising concrete and cooperating to form a box-shaped container having an open end, a generally rectangular horizontal cross-section and a generally rectangular vertical cross-section;

positioning over said bottom unit a pre-fabricated collar unit, comprising:

a first pair of generally opposing upstanding wall sections; and a second pair of generally opposing upstanding wall sections, said first pair of wall sections and said second pair of wall sections comprising concrete and cooperating to form a box-shaped tube having an open upper end, an open lower end, a generally rectangular horizontal cross-section and a generally rectangular vertical cross-section so that said wall portions and said wall sections cooperate to form a first pair and a second pair of walls;

positioning within said box shaped tube a pre-fabricated storage vessel for containing liquids, said storage vessel comprising:

a top;

a bottom;

a first pair of opposing upstanding sides; and a second pair of opposing upstanding sides, said storage vessel having a generally rectangular horizontal cross-section and a generally rectangular vertical cross-section;

wherein said positioning of said vessel is performed such that there is sufficient space between said storage vessel and said vault that an adult can move along at least two of said walls between said vessel and said vault to visually inspect each of said sides of said storage vessel; and positioning over said collar unit a pre-fabricated cover which covers said open upper end of said collar unit.

47. The method of claim 46, further comprising positioning said vessel within said vault such that said vault and said vessel cooperate to form a first physical access gap between a first of said walls and a first of said sides of between 20 and 40 inches.

48. The method of claim 47, further comprising positioning said vessel within said vault such that said vault and said vessel cooperate to form a second physical access gap between a second of said walls and a second of said sides of between 12 and 30 inches.

49. The method of claim 48, further comprising positioning said vessel within said vault such that said vault and said vessel cooperate to form a second physical access gap between a second of said walls and a second of said sides of between 18 and 24 inches.

50. The method of claim 49, further comprising positioning said vessel within said vault such that said vault and said vessel cooperate to form a first visual inspection gap between a third of said walls and a third of said sides of between 2 and 10 inches.

51. The method of claim 50, further comprising positioning said vessel within said vault such that said vault and said vessel cooperate to form a second visual inspection gap between a fourth of said walls and a fourth of said sides of between 2 and 10 inches.

52. The method of claim 51, further comprising positioning said vessel within said vault such that said vault and said vessel cooperate to form a vertical clearance space between said top of said vessel and said cover of said vault having a height between 12 and 36 inches.

53. The method of claim 52, further comprising positioning spacers in said vault such that they support said bottom of said vessel above said bottom of said vault so that the portion of said bottom of said vault beneath said bottom of said vessel can be visually inspected by an adult positioned between said vessel and said vault.

* * * * *